United States Patent [19]

Stanich

[11] Patent Number: 4,534,190

[45] Date of Patent: Aug. 13, 1985

[54] PADLOCK COVER

[76] Inventor: Judith A. Stanich, 1500 S. Ocean Dr., Apt. #1103, Pompano Beach, Fla. 33072

[21] Appl. No.: 554,903

[22] Filed: Nov. 25, 1983

[51] Int. Cl.[3] ..... E05B 67/33

[52] U.S. Cl. ..... 70/54

[58] Field of Search ..... 70/55, 54, 56, 51, 52, 70/20; 150/0.5, 52 R; 206/521

[56] References Cited

U.S. PATENT DOCUMENTS 1,346,414 7/1920 Murphy ..... 70/55

1,581,953 4/1926 Jackson ..... 70/55

3,533,253 10/1970 Miller ..... 70/55

*Primary Examiner*—Robert L. Wolfe

*Attorney, Agent, or Firm*—Oltman and Flynn

[57] ABSTRACT

A molded plastic cover for a padlock. The cover has an annular side wall adapted to snugly surround the padlock body and having slots which are open at one end to pass the opposite legs of an inverted U-shaped shackle on the padlock. At the opposite end the cover has an annular lip which projects radially inward to engage the corresponding end of the padlock body.

6 Claims, 9 Drawing Figures

FIG. 2
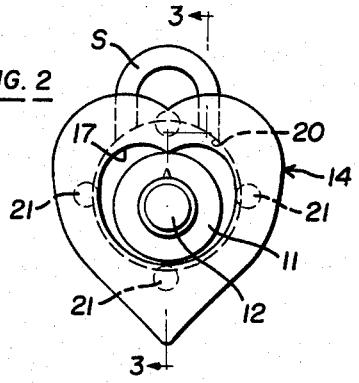
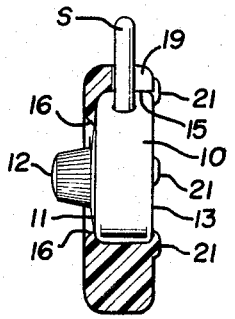
FIG. 3
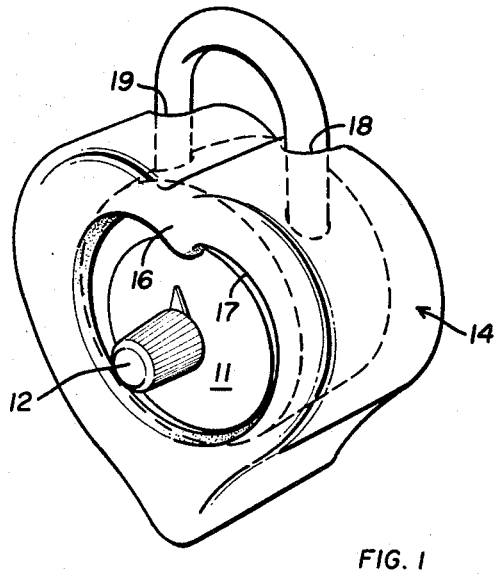
FIG. 1
FIG. 4
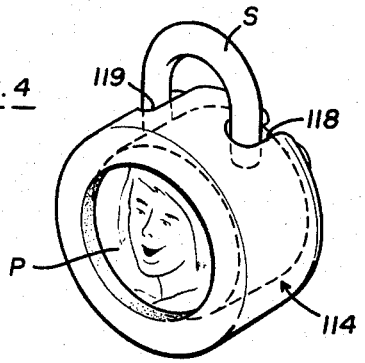
FIG. 6
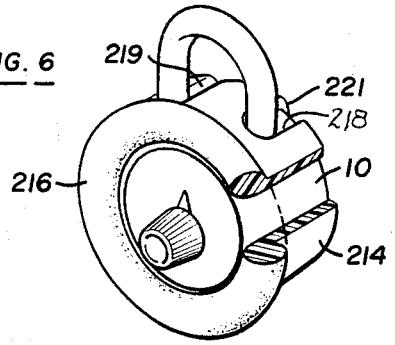
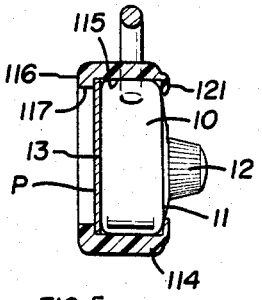
FIG. 5
FIG. 7
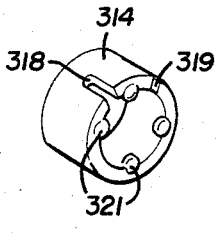
FIG. 8
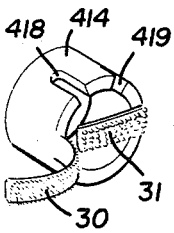
FIG. 9
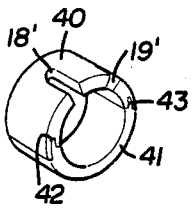

PADLOCK COVER

SUMMARY OF THE INVENTION

This invention relates to a cover for a padlock.

One widely used type of padlock has a cylindrical body containing a combination lock operated by a rotatable knob on the front, and an inverted U-shaped shackle extending up from the body of the lock. Such locks are starkly utilitarian in appearance. The present invention is directed to a novel cover for attachment to such a lock to improve and individualize its appearance, as well as to protect the lock against damage from the outside.

In accordance with this invention, a cover for attachment to a padlock is provided which has an annular side wall adapted to snugly surround the cylindrical wall of the padlock body and having longitudinal slots for receiving the opposite legs of the shackle, and an annular lip for snug engagement with one end face of the padlock body. The annular lip on the cover may be at the end of the padlock where the knob is located and, if so, does not interfere with the user's manipulation of this knob. Alternatively, the annular lip on the cover may be at the opposite end of the padlock from the knob, in which case a photograph or other visually attractive insert may be held in place by the lip on the cover against this end of the padlock. The cover may have a particular non-circular shape, such as a heart shape, to make it attractive and divert attention from the ordinary padlock which it covers.

A principal object of this invention is to provide a novel cover for attachment to a padlock.

Another object of this invention is to provide such a cover which is readily attachable to or removable from a padlock and does not interfere with the usual operation of the padlock when it is in place.

Further objects and advantages of this invention will be apparent from the following detailed description of presently preferred embodiments which are illustrated schematically in the accompanying drawing.

DESCRIPTION OF THE DRAWING

FIG. 1 is a front perspective view of a heart-shaped cover in accordance with the present invention on a padlock of conventional design;

FIG. 2 is a front elevational view of the cover and padlock shown in FIG. 1;

FIG. 3 is a vertical cross-section taken along the line 3—3 in FIG. 2;

FIG. 4 is a rear perspective view of a second embodiment of the present cover on a padlock;

FIG. 5 is a vertical cross-section through the cover and padlock assembly shown in FIG. 4.

FIG. 6 is a front perspective view of a third embodiment of the present cover on a padlock;

FIG. 7 is a fragmentary perspective view showing one type of back end on the cover;

FIG. 8 is a fragmentary rear perspective view showing "Velcro" strips on the back end of the cover; and FIG. 9 is a fragmentary rear perspective view of a two-piece cover in accordance with the present invention.

Before explaining the disclosed embodiments of the present invention in detail it is to be understood that the invention is not limited in its application to the details of the particular arrangements shown, since the invention is capable of other embodiments. Also, the terminology used herein is for the purpose of description and not of limitation.

DETAILED DESCRIPTION

Referring first to FIGS. 1–3, a padlock of known design is shown as having a cylindrical body 10 with a front end face 11 where a rotatable knob 12 is located and a back end face 13. The knob 12 operates a combination lock mechanism inside the body of the padlock in the usual manner. At the top the padlock has the usual rigid shackle S of inverted U-shape which is down (as shown) when the lock is closed and is displaceable upward with respect to the padlock body when the lock is open. When the lock is open, the padlock body may be rotated about one vertical leg of the shackle, or vice versa.

The cover is a one-piece molded body of polypropylene or other suitable plastic material having an annular side wall 14 which is heart-shaped on the outside and on the inside for most of its length axially has a cylindrical surface 15 (FIG. 3) which is complementary to the cylindrical padlock body 10 to snugly surround the latter.

At the front end the cover 14 has a radially inwardly extending lip 16 with an uninterrupted, generally heart-shaped inner edge 17 which throughout its extent has a substantial radial spacing from the knob 12 of the padlock. Consequently, the front end lip 16 on the cover does not interfere with the user's fingers when he or she grasps the knob and turns it to open the combination lock. The front end lip 16 engages the front face 11 of the padlock body a short distance inward from its periphery, as shown in FIG. 3.

At the top the cover is formed with two parallel slots 18 and 19 for receiving the opposite straight legs of the shackle S. Each of these slots is open at the back end of the cover, so that the cover can be slid onto the padlock from front-to-back. The slots are wide enough that the padlock body can be turned with respect to the shackle, or vice versa, after the lock is opened.

At its back end the cover has a generally circular opening 20 which is aligned with its cylindrical inside surface 15. Several short flexible and resilient elements 21 project radially inward at circumferentially spaced locations around this opening. These elements engage the back end face 13 of the padlock body to hold the cover in place on the padlock body.

The cover may be inserted on the padlock body from front-to-back. The deformable elements 21 around the back opening 20 in the cover slide across the cylindrical body 10 of the padlock and when they reach the back end face 13 of the padlock body they snap inward to engage it. The padlock body is snugly received from front to back between the front lip 16 and the back projections 21 on the cover, and around its cylindrical periphery the padlock body is snugly engaged by the cylindrical inside surface 15 of the cover.

As shown in FIGS. 1 and 2, the distinctive heart shape of the cover tends to take the viewer's attention away from the utilitarian nature of the padlock and what many would consider its stark, ugly appearance. In addition, the cover is able to absorb external forces which might damage the padlock or mar its appearance.

FIGS. 4 and 5 shown a second embodiment of the present cover which is applied from back to front on the padlock. The padlock itself is the same as in FIGS. 1–3. The cover has a cylindrical side wall 114 with a cylindrical inside surface 115 that is complementary to the cylindrical padlock body 10. At the right end in FIGS. 4 and 5 the cover has inwardly extending, short, flexible and resilient projections 121 which engage the front end face 11 of the padlock body. These projections are substantially spaced radially outward from the knob 12 of the padlock. At its left end in FIGS. 4 and 5 the cover has a radially inwardly extending annular lip 116 with a circular inner edge 117. In the embodiment shown, this lip holds a photograph P flat against the back end face 13 of the padlock body. The cover has longitudinal slots 118 and 119 which are open at the end of the cover where the projections 121 are located. These slots slidably receive the legs of the shackle S on the padlock.

The cover of FIGS. 4 and 4 is applied to the padlock body by sliding it from back to front over the padlock body. The deformable projections 121 slide across the cylindrical body of the padlock and then they snap inward when they reach the front end 11 of the padlock body.

FIG. 6 shows a third embodiment of the present cover having a cylindrical side wall 214 for snugly encircling the cylindrical body 10 of the padlock along its entire length. At the front end the cover has an integral annular lip or bead 216 of circular cross-section, the inside of which projects slightly radially inward across the front end face 11 of the padlock body. At its back end the cover has flexible and resilient projections 221 like the projections 21 in the embodiment of FIGS. 1–3. Longitudinal slots 218 and 219 in the top of the cover are open at its back end.

FIG. 7 shows a cover having a cylindrical side wall 314 with longitudinal slots 318 and 319 which are open at its back end and inwardly extending, flexible and resilient projections 321 on its back end like the projections 21 in the first embodiment.

FIG. 8 shows a cover having a cylindrical side wall 414, slots 418 and 419, and flexible "Velcro" strips 30 and 21 on its back end with locking filaments which engage each other when strip 30 overlaps strip 31. Strip 31 may be placed against the back end face of the padlock body and then strip 30 may be pulled taut and applied against strip 31 to lock the two strips to each other across the end of the padlock body.

FIG. 9 shows a cover of two-piece construction having a semi-cylindrical upper piece 40 with longitudinal slots 18' and 19' open at its back end and a semi-cylindrical lower piece 41. The two pieces of the cover fit together at longitudinal tongue-and-groove joints 42 and 43 on opposite sides of the cylindrical body of the padlock. The two cover pieces 40 and 41 may be applied to the padlock body from above and below, respectively, to form a unitary annular cover for the padlock.

I claim:

1. For attachment to a padlock having a generally cylindrical body and an inverted U-shaped shackle having opposite legs extending up from said body, a cover of deformable and resilent material having:

an annular side wall having opposite ends and having a generally cylindrical inside surface between said ends which is substantially complementary to said body of the padlock to snugly engage the latter;

said cover being open at one end of said annular side wall;

said side wall of the cover having a pair of circumferentially spaced parallel slots therein which are open at said one end of the cover and extend longitudinally of the side wall for slidably receiving the opposite legs of the shackle of the padlock when the body of the padlock is inserted from said one end inside said annular side wall of the cover;

and said cover having an opening at the opposite end of said annular side wall which is smaller than the body of the padlock and radially inwardly extending lip means at said last-mentioned opening for engagement with a corresponding end face of the padlock body.

2. A padlock according to claim 1 and further comprising:

a plurality of flexible and resilient elements projecting a short distance radially inward from said side wall at said one end of the cover for snap-on engagement with the corresponding end of the padlock body.

3. A padlock cover according to claim 2 wherein:

said annular side wall is substantially heart-shaped on its outer periphery;

and said opening at the inside of said lip means at said opposite end of said side wall is substantially heart-shaped.

4. A padlock cover according to claim 1 wherein:

said annular side wall is substantially heart-shaped on its outer periphery.

5. A padlock cover according to claim 1 and further comprising:

a pair of flexible strips with interlocking filaments attached to said one end of said annular side wall for manually attachable and releasable overlapping engagement with each other.

6. A padlock cover according to claim 1 and composed of separate arcuate segments which fit together snugly around the padlock body to form said annular side wall and said lip means of the cover.

* * * * *